United States Patent [19]

Rahman

[11] Patent Number: 4,655,784

[45] Date of Patent: Apr. 7, 1987

[54] METHOD OF PRINTING CARPET TILES

[75] Inventor: Zafar Rahman, Simpsonville, S.C.

[73] Assignee: Bigelow-Sanford, Inc., Greenville, S.C.

[21] Appl. No.: 738,168

[22] Filed: May 24, 1985

[51] Int. Cl.[4] ..... D06B 5/22; B41F 15/10

[52] U.S. Cl. ..... 8/148; 8/149.1; 101/129

[58] Field of Search ..... 8/148, 149.1, 150; 101/115, 129

[56] References Cited

U.S. PATENT DOCUMENTS

| | | | |
|---|---|---|---|
| 2,816,811 | 12/1957 | Tillett et al. | 8/148 |
| 2,984,540 | 5/1961 | Tillett et al. | 8/148 |
| 3,175,488 | 3/1965 | Tillett et al. | 8/148 X |
| 4,031,280 | 6/1977 | Weller et al. | 8/148 X |
| 4,165,547 | 8/1979 | Parlin et al. | 8/148 |
| 4,336,753 | 6/1982 | Vidalis | 101/115 X |

*Primary Examiner*—Philip R. Coe

*Attorney, Agent, or Firm*—Bell, Seltzer, Park & Gibson

[57] ABSTRACT

A method of sequentially coloring individual, precut, backed carpet tiles comprising moving an individual, precut, backed carpet tile into overlying spaced relationship with a tuft dye mold of substantially the same size as the carpet tile, with the tuft dye mold having a plurality of dye mold sections therein separated from one another by a vertical divider walls within the tuft dye mold. The tufted side of the carpet tile is brought into engagement with the tuft dye mold which has predetermined amounts of fluid colorant in any one or more desired sections thereon for imparting color to a portion of the carpet tile corresponding to said section or sections. A predetermined amount of pressure is exerted on the carpet tile on the tuft dye mold and on the fluid colorant therein and thereby minimizes the migration of colorant from one portion of the carpet tile to another portion while thoroughly impregnating each of said predetermined portions with said fluid colorants.

16 Claims, 5 Drawing Figures

METHOD OF PRINTING CARPET TILES

FIELD OF THE INVENTION

The present invention relates to the printing of one or more colors on individual, precut, backed carpet tiles.

BACKGROUND OF THE INVENTION

One of the more popular developments in floor coverings in recent years is the individual precut backed carpet tile, usually of a size comparable to more traditional types of tiles such as linoleum. Carpet tiles provide flexibility in designing and obtaining floor coverings where the performance and appearance of carpet are desired, but where traditional roll or area carpeting may not be appropriate because of cost, flexibility, area geometry or other factors.

Prior to the development of tiles having the various characteristics desirably found in carpeting such as durability and appearance, carpeting choices were generally limited to area rugs or wall-to-wall carpeting formed from single pieces or rolls of carpet. Area rugs are of certain definite sizes and consequently may only be used in certain types of areas. Similiarly, regular roll or wall-to-wall type carpeting must be customized to fit the areas in which it is to be used. In contrast, the carpet tile provides a more efficient method of obtaining carpeting both on areas which are traditionally difficult to carpet and on those which have traditionally been carpeted with area rugs or wall-to-wall carpets. Carpet tiles can be easily laid individually in column by row arrays, and only the carpet tiles which border the edges of the area to be carpeted need be customized. Either wall-to-wall or definite areas of carpeting may be accomplished. Similarly, replacement of worn and damaged tiles can be done in limited areas.

A desirable carpet tile will exhibit the necessary qualities with respect to both function and appearance which are desirably required of other types of carpeting.

A carpet tile generally comprises some sort of primary backing, to which the fibers, tufts or loops forming the carpet face are attached. Functionally, because individual carpet tiles are relatively small, e.g. 18"×18", they are also relatively light in weight and individually do not have the amount of inertial weight that an entire piece of area or wall-to-wall carpet would have, and which helps maintain the carpet in a flat orientation. Consequently, the carpet tile must have some additional backing characteristics enabling it to lay flat of its own accord, rather than as a result of being a small portion of a much larger heavier carpet held flat by its own weight. Because of their small size and weight, most carpet tile is backed after weaving or tufting with an impermeable backing of resilient material, such as PVC, polyurethane or the like, which provides added stiffness and weight and which helps the carpet tile lay flat by itself.

Preferably, carpet tile is formed by die cutting smaller tile size sections from previously woven, tufted or fiber bonded carpet. For example, tile may be formed by tufting yarns through a permeable primary backing to form a length or roll of carpet of a given width, e.g. 3, 9 or 12 feet. The surface of the primary backing opposite to the tufts forming the carpet face may then have resilient material such as latex, polyvinyl chloride (PVC), foam, etc. coated thereon or otherwise applied thereto, after which the backed carpet fabric is cut into the desired dimensions for individual tiles.

For the sake of appearance, a carpet carrying one or more designs is often desirable. When area carpets or roll carpets are manufactured, they may be either woven with multiple colors of yarn, or printed or dyed after weaving to produce desired designs. In a similar manner, where carpeting is formed from carpet tiles, a design which may be either repetitive from tile to tile or which builds from tile to tile into a larger design is also sometimes desirable.

Certain difficulties arise, however, in the production of carpet tiles carrying designs. First, where patterned carpet tiles are cut from larger portions of patterned carpet, the cutting process can distort the pattern. In such cases, a desired pattern formed from the cut tiles cannot be reproduced from carpet to carpet and often the original pattern of the larger carpet from which the carpet tiles were cut cannot be accurately recreated. Moreover, where the pattern design repeat is larger than any individual tile, the distorted tiles make difficult the orientation of individual tiles to create or recreate a pattern.

There exist other problems in obtaining individual carpet tiles carrying precisely and accurately reproduced patterns. For example, one method of printing carpet tiles to get precise and accurate pattern repetition is the screen stenciling process. In this process, used to color many textile items, individual carpet tiles are moved past a screen stencil, often in the form of a roller. Colorant is applied through predetermined portions of the screen onto corresponding portions of the surface of the carpet tile. While good pattern repetition may be obtained by screen stenciling, those familiar with screen stenciling will be aware that this method generally provides only a surface coloring of deeper pile fabrics such as carpet tufts. When only the upper surfaces of the tufts of the carpet tiles are so colored, several problems arise. First, because of the lack of color in the lower portions of the tufts, the surface colored tufts can give an unpleasant appearance when movement or traffic causes them to become moved. Second, such surface coloring will often wear faster than will the carpet itself, resulting in a shorter lifetime of the desired pattern.

In coloring portions of carpeting of larger, traditional sizes, certain methods have been proposed for avoiding some of the limitations of screen stencil printing. In particular the use of a tuft dye mold has been used in coloring pile fabrics such as tufted carpets. A tuft dye mold generally comprises a horizontal mold of a size corresponding to the article of tufted fabric to be colored. The horizontal mold is divided into various sections corresponding to the pattern of color desired on the final object by a number of vertical walls within the horizontal mold. The various walls serve to separate various sections of the mold from each other and to separate corresponding sections of the pile fabric from one another when brought into contact therewith. In printing a tufted fabric, the tufted fabric is either first brought in contact with the mold followed by the addition of fluid colorant to the individual sections, or colorant may be added first following which the tufted fabric is moved into engagement with the mold. In either case, the vertical divider walls between respective colorant-containing sections serve two purposes: they slip through the tufts of the fabric and provide definite lines of demarkation between respective portions of the tufted fabric, and they provide a barrier to the flow of colorant preventing it from migrating from one respective portion of the tufted fabric to another. Ideally, coloring using a tuft-dye mold produces color along the entire length of the carpet tuft, resulting in a rich appearance in the pattern which will remain visible for the life of the carpet, regardless of wear. Typical methods and devices for attempting such printing on large roll and/or piece carpeting include those described in U.S. Pat. Nos. 4,031,280; 3,175,488; 2,984,540; and 2,816,811.

With regard to individual, backed carpet tiles, however, problems arise in tuft dye mold printing which are not of concern in printing larger pieces of carpet, but which have heretofore prevented its use on backed carpet tiles. Basically, as set forth earlier herein, larger pieces of carpet have primary backings of permeable material. When such a carpet is printed using a tuft dye mold, the woven backing provides a fluid-permeable surface through which colorant may flow whenever there is an excess of colorant in any one or more of the respective portions of the tuft dye mold. Since at this stage the carpet has not yet received a resilient backing excess color will flow through the primary backing rather than migrating into adjacent pattern areas. Because of this safety zone provided by the permeable backing, excess colorant is easily prevented from flowing into non-designated areas and is thus prevented from spoiling the appearance of the pattern.

In coloring carpet tile, after it has been cut and backed, there is no "safety zone" into which excess colorant can flow because of the impermeable resilient backing. Consequently, excess colorant tends to migrate between various sections of the carpet, even forcing its way past the vertical barriers in the tuft dye mold. This may result in a carpet tile with poor color resolution between adjacent colored areas and an undesirable final appearance.

Additionally, the tuft dye mold printing processes developed for large carpets tend to be most suitable for low viscosity, highly fluid colorants the placement of which, while satisfactory enough for larger patterns on larger carpets, cannot be controlled with the accuracy and precision required to reproduce a pattern on the much smaller scale of a carpet tile.

Finally, where the face portion of the carpet is of the "level loop" type, previous attempts to accomplish tuft dye mold printing have been unsuccessful on carpets of all sizes because of the difficulty in controlling the flow of colorant on, around and through the loops.

It is thus an object of the present invention to provide a method by which individual backed carpet tiles may be both accurately and precisely colored so that any carpet pattern formed from these tiles will be of the desired final pattern regardless of the order in which the individual tiles were printed.

It is another object of the present invention to provide a method of coloring individual precut backed carpet tiles in a tuft dye mold while producing colorant penetration along the entire length of the tufts, whether cut pile or loops, along with high resolution and definition of colored portions of the carpet tile.

SUMMARY OF THE INVENTION

The present invention comprises a method of sequentially coloring individual precut, backed carpet tiles which comprises moving an individual, precut backed carpet tile into overlying spaced relationship with a tuft dye mold of substantially the same size as the carpet tile. The tuft dye mold has a plurality of dye mold sections therein separated from one another by vertical divider walls within the tuft dye mold. The tufted side of the carpet tile is brought into engagement with the tuft dye mold which has predetermined amounts of fluid colorant of the same or different colors in any one or more desired sections thereof for imparting color to the face portion of the carpet tiles corresponding to the section or sections. A predetermined amount of pressure is exerted on the carpet tile, on the tuft dye mold and on the fluid colorant therein. Correlation of the amount of colorant and pressure minimizes migration of colorant from one portion of the carpet tile to another portion while thoroughly impregnating each of the predetermined portions with the respective fluid colorants.

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments, and wherein.

DETAILED DESCRIPTION OF THE INVENTION

Figure 1:
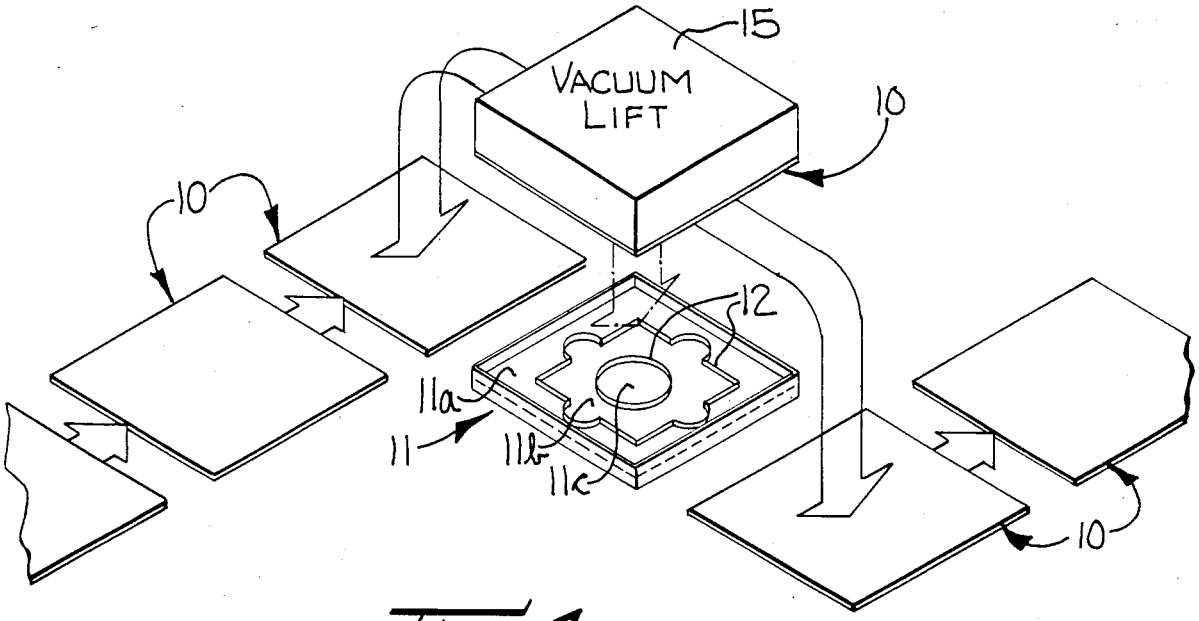
FIG. 1 is a perspective schematic view showing the movement of a carpet tile through the printing step of the process.

As set forth in the background of the invention, the printing of individual, precut, backed carpet tiles raises several specific problems not solved by the conventional methods of printing larger items of tufted fabrics. Accordingly, and as illustrated in FIG. 1, a first step in the method of the present invention comprises moving one such carpet tile, broadly designated at 10, into overlying spaced relationship with a tuft dye mold 11.

Figure 5:
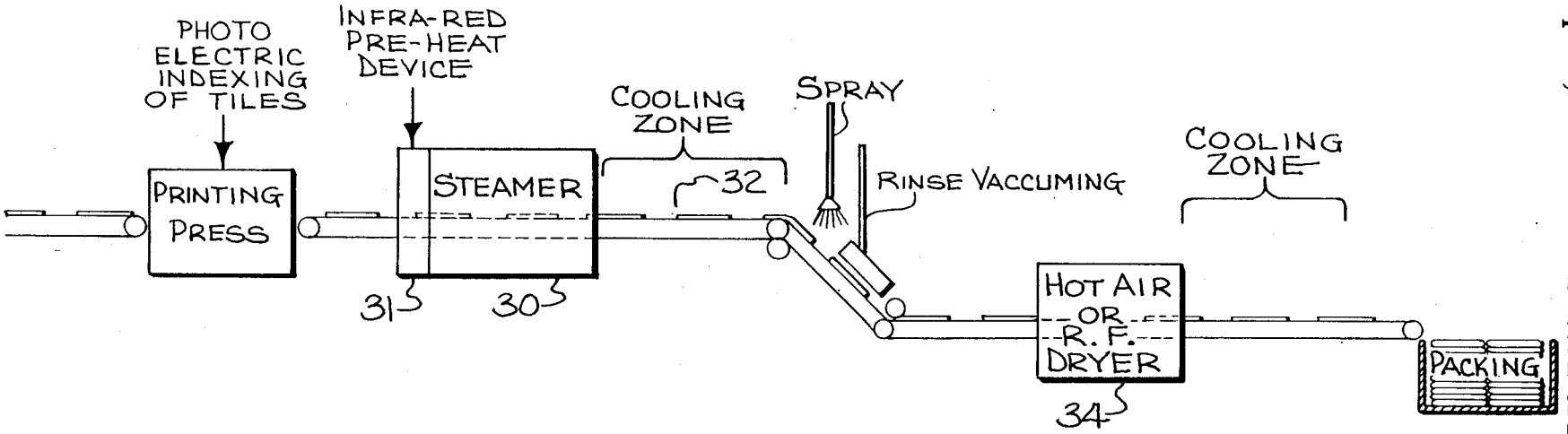
FIG. 5 is a flow sheet illustrating the method of the present invention.

In the illustrated embodiment of the invention, the carpet tile 10 is moved into overlying relationship with the tuft dye mold 11 by any suitable means such as a vacuum lift 15 which properly indexes the carpet tile with regard to the tuft dye mold. As indicated in FIG. 5, one such method of indexing may use a photoelectric device to properly align the carpet tile 10 and the tuft dye mold 11. The tuft dye mold is of substantially the same size as the carpet tile 10 in order to accomplish accurate registration between the carpet tile and the tuft dye mold and thereby provide precise reproduction of a desired printed pattern as one tile after another is indexed and registered. The tuft dye mold 11 has a plurality of dye mold sections therein which are separated from one another by vertical divider walls 12 within the tuft dye mold. In the illustrated embodiment these sections are designated 11*a*, 11*b* and 11*c*. According to the present invention any reasonable number of such sections may be accomplished by the proper design and placement of these divider walls.

Figure 2:
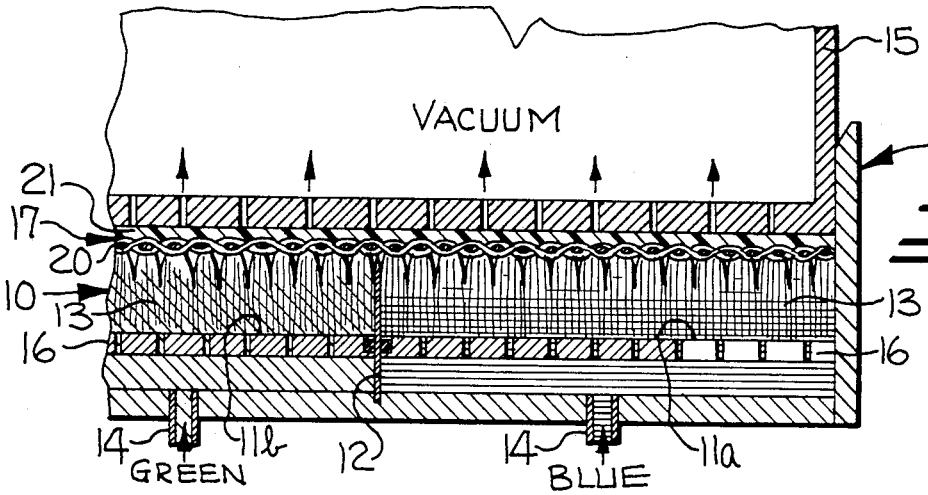
FIG. 2 is a partial sectional view of a carpet tile in engagement with a tuft dye mold.

In the present invention, a predetermined amount of fluid colorant of one or more colors and of a selected viscosity is added and maintained in any one or more desired sections of the tuft dye mold 11. In the embodiment illustrated in FIG. 2, fluid colorant is added through colorant accessways, shown as the tubes 14, and reaches the carpet tufts through suitable dispersal means such as the perforated planar members 16 shown in FIG. 2. As illustated in more detail in FIG. 2, the tufted side 13 of the carpet tile is then brought into engagement with the tuft dye mold so that color may be imparted to the one or more portions of the carpet tile corresponding to the one or more sections having fluid colorant therein. In the partial section view of FIG. 2, sections 11*a* and 11*b* of the tuft dye mold 11 are shown in engagement with respective portion, of the tufted side 13 of the carpet tile 12.

In the present invention, the divider walls 12 of the tuft dye mold are of one or more selected heights which have a predetermined relationship to the tufts of the carpet tile. As is known to those familiar with carpet, the tufts of the carpet can comprise cut tufts or loops, can be of greater or lesser lengths, larger or smaller fibers, natural or synthetic fibers of different chemical makeup and greater or lesser fiber density per given amount of area. In the present invention it is important to correlate both the selected height of the divider walls 12 in the tuft dye mold 11 with the amount and viscosity of fluid colorant added and maintained to the predetermined sections of the tuft dye mold 11 so as to correspond to the particular characteristics of the tufts of the carpet tile to be printed.

Figure 4:
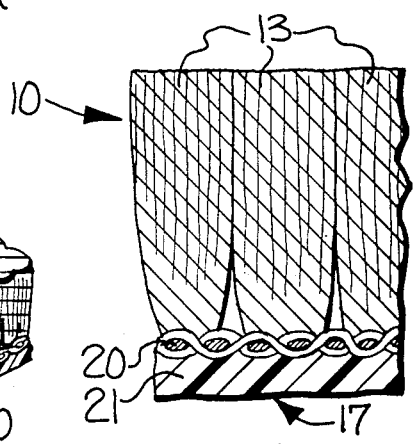
FIG. 4 is an enlarged sectional view of a small portion of the carpet tile, particularly showing the tufts, the fabric backing and the resilient backing.

After the carpet tile is brought into engagement with the tuft dye mold containing the predetermined amount of fluid colorants, a predetermined amount of pressure is exerted on the carpet tile 10 in order to cause the divider walls 12 of the mold sections to penetrate the carpet tufts and press against the base 17 of the carpet tile. As illustrated in particular detail in FIG. 4, the base 17 of the carpet tile 10 comprises a primary backing 20 penetrated by the tufts 13 and a resilient impermeable backing 21, which may be of several layers, for giving the carpet tile the desirable characteristics set forth previously herein. For purposes of clarity, the primary backing of the illustrated carpet tiles has been shown as a woven backing, but it is to be understood that the invention is not limited to use on carpet tile having a primary backing of woven fabric.

The predetermined amount of pressure must be carefully correlated to the fiber and to other characteristics of the carpet face. The predetermined pressure must be great enough to cause the fluid colorants to thoroughly impregnate the entire lengths of the tufts of the carpet tile, while limited enough to minimize or eliminate migration of colorants of different colors from one portion of the carpet tile to another portion. The predetermined pressure must be exerted across the entire portion of the tile being printed and must also take into account the characteristics of the impermeable backing of the carpet tile, which prevents excess colorant from flowing through the primary backing material to the underside of the tile.

Uneven or insufficient pressure may result in insufficient or uneven impregnation. Simply exerting as much pressure as possible, or some other random amount of pressure, will cause problems in color resolution in spite of the divider walls of the tuft dye mold. Excess pressure causes colorant to migrate to undesignated portions of the carpet tile regardless of the presence of the divider walls. Thus, the predetermined amount of pressure must be carefully selected and correlated with other factors to accomplish all of the objects of the invention while avoiding the disadvantages inherent in prior techniques.

After the predetermined amount of pressure has been exerted on the carpet tile for an appropriate period of time, the carpet tile is disengaged from the tuft dye mold and moved to another position for further processing.

Figure 3:
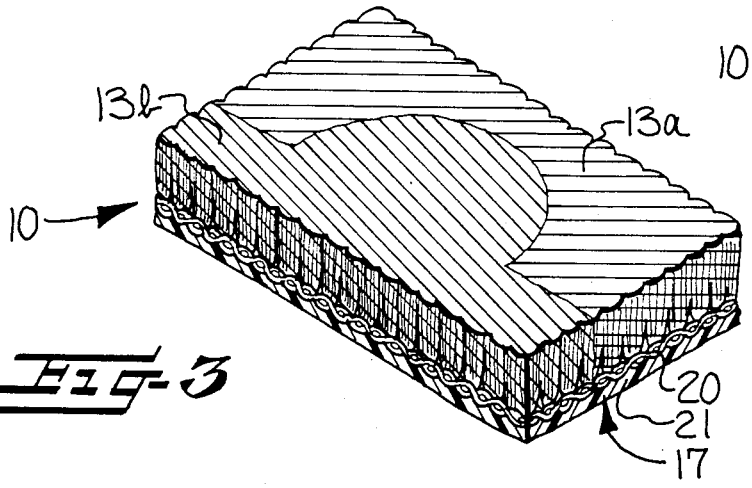
FIG. 3 is a perspective sectional view of a portion of the carpet tile.

As illustrated in FIG. 3, the method of the present invention produces a printed carpet tile having well-defined colored printed areas designated as 13*a* and 13*b*. In addition to superior definition, the printed areas are characterized by the penetration and presence of printed color along substantially the entirety of the tufts, from the exposed face of the tufted side of the carpet tile all the way to the base 17.

Specific examples of colorant compositions, amounts, viscosities, pressures and dwell times are given in Tables I and II.

TABLE I

| Base: | Level Loop, 28 Oz./Sq. Yd., Filament | Grams/ Liter |
|---|---|---|
| Color: | South Seas | |
| Dyes: | Intralan Yellow NW 250% | 0.2 |
| | Intralan Navy Blue NLF | 16.0 |
| Color: | Geisha Red | |
| Dyes: | Intralan Yellow NW 250% | 0.24 |
| | Intralan Red 2G 200% | 5.0 |
| Color: | Rustic Burgundy | |
| Dyes: | Intralan Orange RDL | 5.0 |
| | Intralan Bordeaux RLB 300% | 9.50 |
| Print Paste Composition | | |
| | Celcagum D-74 | 5.0 |
| | Progawet Doss | 15.00 |
| | Sequestrene 30-A | 2.5 |
| | Formic Acid to pH 2.5 | — |
| | Viscosity - 30–34 seconds with Zahn Cup #2 (165 centipoise). | |
| Print | | |
| | 1 Ton Pressure, 2 seconds dwell time, 0.35–0.5 cc of print liquor/$^2$inch. | |

TABLE II

| Base: | Cut Pile, 28 Oz./Sq. Yd., Staple | Grams/ Liter |
|---|---|---|
| Color: | South Seas | |
| Dyes: | Intralan Yellow NW 250% | 0.2 |
| | Intralan Navy Blue NLF | 16.0 |
| Color: | Geisha Red | |
| Dyes: | Intralan Yellow NW 250% | 0.24 |
| | Intralan Red 2G 200% | 5.00 |
| Color: | Rustic Burgundy | |
| Dyes: | Intralan Orange RDL | 5.00 |
| | Intralan Bordeaux RLB 300% | 9.50 |
| Print Paste Composition | | |
| | Celcagum D-74 | 4.5 |
| | Progawet Doss | 15.00 |
| | Sequestrene 30-A | 2.5 |
| | Formic Acid to pH 2.5 | — |
| | Viscosity - 16–20 seconds with Zahn Cup #2 (30 centipoise). | |
| Print | | |
| | 7 Tons Pressure, 2 seconds dwell time, 0.75 cc of print liquor/$^2$inch | |

Depending on the type of colorant used on the carpet tile, further treatment of freshly printed tiles can comprise fixing the colorant onto to the carpet tile. Several potential steps in the further treatment of carpet tiles are illustrated in FIG. 5. In this regard, colors can be applied to fabrics in chemical forms that do not become permanently fixed onto or into the fabric until some further procesing step beyond the actual printing or screening step takes place. One such method of fixing which can be appropriate in accordance with the present invention is steam fixing in a steamer 30. A preheating step may be included prior to steaming and in one embodiment of the invention may be accomplished with an infrared heating device 31. The heat and moisture provided by the steaming step causes a desired amount of colorant to become chemically fixed upon the fibers which make up the carpet tufts thereby making permanent the color added in the printing step.

After steam fixing, the carpet tile may be allowed to cool, if desired, by exposure to ambient air. In the illustrated process, cooling takes place as the carpet tiles travel along a cooling zone 32 after exiting the steamer 30. At this point, a carpet tile printed according to the present invention will have colorant fixed into the tufts of the carpet fiber but may also contain some excess colorant which did not become fixed. Accordingly, if such an excess occurs, or if otherwise desired, any excess unfixed colorant may be removed from the carpet tile, and one preferred method of accomplishing such removal designated in FIG. 5 is rinse vacuuming; i.e. a water spray and rinse followed by immediate vacuuming of the carpet tile. This accomplishes both removal of the unfixed colorant and also removal of a large portion of the moisture added by the rinse.

With the majority of water so removed, the printed carpet tile may next be moved through another dryer 34, such as a hot air or microwave dryer, to completely remove any remaining moisture.

The carpet tile may then be allowed to cool a second time and if necessary return to a substantially planar orientation and become ready for packaging and use.

Although the method of the invention has been described with respect to a single carpet tile, the method of the invention further comprises the sequential coloring a number of individual, precut backed carpet tiles. Proceeding sequentially, the method comprises disengaging a first carpet tile from the tuft dye mold after the printing step and moving the first carpet tile out of overlying relationship with the tuft dye mold while concurrently bringing a second carpet tile into identical overlying spaced relationship with the tuft dye mold, and then repeating the engagement and pressure exerting steps such that continuous, step-wise sequential coloring of individual precut backed carpet tiles takes place. When accomplished according to the present invention, any number of carpet tiles can be sequentially, accurately and precisely colored in an identical fashion, resulting in carpet tiles which will have a highly desirable appearance when positioned adjacent one another for use as a floor covering.

The foregoing embodiments are to be considered illustrative, rather than restrictive of the invention, and those modifications which come within the meaning and range of equivalence of the claims are to be included therein.

That which is claimed is:

1. A method of accurate and precise coloring of individual, pre-cut, backed carpet tiles, said method comprising:

moving an individual, pre-cut carpet tile having a tufted carpet face and a fluid-impermeable resilient backing into a predetermined position of registration;

mechanically segregating the entire carpet face into predetermined portions, all of which portions are mechanically separated from one another along the entirety of the lengths of the tufts thereof from said fluid-impermeable resilient backing to the face ends of said tufts;

adding predetermined amounts of relatively high viscosity fluid colorant to one or more of the segragated portions of the carpet tile;

exerting an amount of pressure on said carpet tile and on said fluid colorant in said designated segregated portions sufficient to cause the colorant to impregnate the entirety of the lengths of the tufts while limited enough to prevent the colorant from migrating out of the segregated portion or portions of the carpet tile; and correlating said movement, said segregation, said addition of fluid colorant and said exertion of pressure to cause said fluid colorant to throughly impregnate said tufts in each of said predetermined portions along substantially the entire length of said tufts while preventing said fluid colorant from migrating substantially past said ends of said tufts or from migrating substantially horizontally along said backing.

2. A method of coloring individual, pre-cut, backed carpet tiles, said method comprising:

moving an individual, pre-cut carpet tile having a tufted carpet face and a fluid-impermeable resilient backing into overlying spaced relationship with a tuft dye mold of substantially the same size as the carpet tile, said tuft dye mold having a plurality of dye mold sections therein, all of which dye mold sections are mechanically separated from one another by vertical divider walls within said tuft dye mold;

bringing the tufted side of said of said carpet tile into engagement with said tuft dye mold having predetermined amounts of relatively high viscosity fluid colorant in any one or more desired sections thereof for imparting color to a portion of said carpet tile corresponding to said section or sections;

exerting an amount of pressure on said carpet tile, on said tuft dye mold and on said fluid colorant therein sufficient to cause the colorant to impregnate the entirety of the lengths of the tufts while limited enough to prevent the colorant from migrating out of the desired section or sections of the carpet tile; and correlating said movement, said engagement, said amounts of fluid colorant and said exertion of pressure to minimize migration of colorant from one portion of said carpet tile to another portion whie throughly impregnating each of said predetermined portions with said fluid colorants.

3. A method according to claim 2 further comprising disengaging said carpet tile from said tuft dye mold and moving said carpet tile out of overlying relationship with said tuft dye mold while concurrently bringing another carpet tile into identical overlying spaced relationship with said tuft dye mold and repeating said engagement and pressure exerting steps such that said method provides a continuous step-wise sequential coloring of individual, pre-cut, backed carpet tiles.

4. A method according to claim 2 wherein said fluid colorants include colorants of at least two different colors.

5. A method according to claim 2 wherein said fluid colorant thoroughly impregnates the tufts of said carpet tile.

6. A method according to claim 2, further comprising fixing said colorant on said carpet tile and removing excess unfixed colorant from the carpet tile.

7. A method according to claim 6 further comprising rinse vacuuming of said carpet tile to remove unfixed colorant therefrom and removing moisture from said carpet tile.

8. A method according to claim 2 wherein said amounts of fluid colorant are predetermined according to the type of carpet fiber, the tuft density, and the tuft height of said carpet tile.

9. A method of sequentially coloring individual, pre-cut, backed carpet tiles with at least two different colors and for providing greater definition and resolution between adjacent areas of differing colors, said method comprising the following steps:

(a) moving a first individual, pre-cut carpet tile having a tufted carpet face and a fluid-impermeable resilient backing into overlying spaced relationship with a tuft dye mold of substantially the same size as the carpet tile, said tuft dye mold having a plurality of dye mold sections therein, all of which sections are mechanically separated from one another by vertical divider walls within said tuft dye mold;

(b) bringing the tufted side of said carpet tile into engagement with said tuft dye mold to the extend that the divider walls of the mold meet the fluid-impermeable resilient backing of the carpet tile;

(c) adding and maintaining predetermined amounts of relatively high viscosity fluid colorant of at least two different colors to predetermined sections of said tuft dye mold such that only one color is added to any one of said predetermined sections;

(d) exerting an amount of pressure on said carpet tile sufficient to cause the colorant to impregnate the entirety of the lengths of the tufts while limited enough to prevent the colorant from migrating out of the desired section or sections of the carpet tile;

(e) correlating said movement, said engagement, said addition of fluid colorant and said exertion of pressure to minimize the migration of colorants of different colors from one portion of said carpet tile to another portion while thoroughly impregnating each of said predetermined portions with said fluid colorants such that the tufts of said carpet tile are thoroughly impregnated with said fluid colorant;

(f) disengaging said first carpet tile from said tuft dye mold and moving said carpet tile out of overlying relationship with said tuft dye mold while concurrently bringing a second carpet tile into identical overlying spaced relationship with said tuft dye mold;

(g) fixing said colorant on said carpet tile;

(h) removing excess unfixed colorant from said carpet tile; and (i) repeating the steps (a) through (g) for said second carpet tile and for each successive carpet tile to be colored such that said method provides a continuous step-wise sequential coloring of individual, pre-cut, backed carpet tiles.

10. A method according to claim 9 wherein said vertical divider walls in said tuft dye mold are of one or more selected heights having a predetermined relationship to said tufts of said carpet tile.

11. A method according to claim 9 wherein said fixing comprises steam fixing.

12. A method according to claim 11 wherein said moisture removal further comprises application of mechanical pressure to said carpet tile and heating said carpet tile to dryness.

13. A method according to claim 7 wherein said fluid colorant is of a selected viscosity.

14. A method of sequentially coloring individual, pre-cut, backed tufted carpet tiles with at least two different colors and for providing greater definition and resolution between adjacent areas of differing colors and producing a plurality of tiles with identical patterns, said method comprising the following steps:

(a) moving a first individual, pre-cut carpet tile having a tufted carpet face and a fluid-impermeable resilient backing into overlying spaced relationship with a tuft dye mold of substantially the same size as said carpet tile, said tuft dye mold further comprising;

a plurality of dye mold sections therein, all of which dye mold sections are mechanically separated from one another by vertical divider walls within said tuft dye mold; and said vertical divider walls in said tuft dye mold being of one or more selected heights having a predetermined relationship to said tufts of said carpet tile;

(b) bringing the tufted side of said carpet tile into engagement with said tuft dye mold;

(c) adding and maintaining predetermined amounts of relatively high viscosity fluid colorant of at least two different colors to predetermined sections of said tuft dye mold such that only one color is added to any one of said predetermined separated sections, said amounts of fluid colorant being predetermined according to the type of carpet fiber, the tuft density and the tuft height of said carpet tile;

(d) exerting an amount of pressure on said carpet tile which causes said divider walls of said mold sections to penetrate the carpet tufts and press against the fluid impermeable resilient backing of said carpet tile;

(e) correlating said movement, said engagement, said addition of fluid colorant and said exertion of pressure to minimize the migration of colorants of different colors from one portion of the carpet tile to another portion while thoroughly impregnating each of said predetermined portions with said fluid colorants such that the tufts of said carpet tile are thoroughly impregnated with said fluid colorants;

(f) disengaging said first carpet tile from said tuft dye mold and moving said carpet tile out of overlying relationship with said tuft dye mold while concurrently bringing a second carpet tile into indentical overlying spaced relationship with said tuft dye mold;

(g) steam fixing said colorant on said first carpet tile;

(h) rinse vacuuming said first carpet tile to remove unfixed colorant therefrom;

(i) heating said first carpet tile to dryness;

(j) returning said first carpet tile to a substantially planar orientation, and (k) repeating steps (a) through (i) for said second carpet tile and for each successive carpet tile to be colored such that said method provides a continuous, step-wise sequential coloring of individual, pre-cut, backed carpet tiles.

15. A method according to claim 1 wherein said relatively high viscosity fluid colorant has a viscosity of about 30 centipoise.

16. A method according to claim 1 wherein said relativley high viscosity fluid colorant has a viscosity of about 165 centipoise.

* * * * *

UNITED STATES PATENT AND TRADEMARK OFFICE

CERTIFICATE OF CORRECTION

PATENT NO. : 4,655,784

DATED : April 7, 1987

INVENTOR(S) : Zafar Rahman

It is certified that error appears in the above-identified patent and that said Letters Patent is hereby corrected as shown below:

Column 8, line 17; "throughly" should be --thoroughly--

Column 8, line 35; "of said of said" should be --of said--

Column 8, line 52; "whie" should be --while--

Column 8, line 53; "throughly" should be --thoroughly--

Column 9, line 30; "extend" should be --extent--

Signed and Sealed this

Twenty-seventh Day of October, 1987

*Attest:*

DONALD J. QUIGG

*Attesting Officer*

*Commissioner of Patents and Trademarks*